United States Patent [19]

Kikuchi

[11] Patent Number: 4,844,146

[45] Date of Patent: Jul. 4, 1989

[54] DIE CASTING APPARATUS

[75] Inventor: Kosuke Kikuchi, Wako, Japan

[73] Assignee: Kabushiki Kaisha Tetsan Industries, Tokyo, Japan

[21] Appl. No.: 262,106

[22] Filed: Oct. 19, 1988

Related U.S. Application Data

[63] Continuation-in-part of Ser. No. 42,377, Apr. 14, 1987, abandoned.

[30] Foreign Application Priority Data

Feb. 16, 1987 [JP] Japan ..... 62-32905

[51] Int. Cl.[4] ..... B22D 17/00

[52] U.S. Cl. ..... 164/154; 164/319; 164/120; 164/312

[58] Field of Search ..... 164/319, 320, 312, 120, 164/4.1, 154

[56] References Cited

FOREIGN PATENT DOCUMENTS 57-50266 3/1982 Japan ..... 164/120

57-171559 10/1982 Japan ..... 164/120

*Primary Examiner*—Kuang Y. Lin

*Attorney, Agent, or Firm*—Robert E. Burns; Emmanuel J. Lobato

[57] ABSTRACT

A die casting apparatus comprising a secondary pressing cylinder mounted on one mold, a sequence valve, a control valve and a reducing valve, the valves being interposed between a switching valve and the secondary pressing cylinder. Operating timing of the secondary pressing cylinder is changed by the sequence valve, the moving speed of the pressing plunger is adjusted by the flow control valve, and the pressing force of the pressing plunger is varied by the reducing valve. The operation of secondary pressing is adjusted by the sequence valve and the flow control valve.

1 Claim, 4 Drawing Sheets

DIE CASTING APPARATUS

This application is a continuation-in-part of Ser. No. 042,377, filed Apr. 14, 1987, now abandoned.

BACKGROUND OF THE INVENTION

1. Field of the Invention

This invention relates to a novel die casting apparatus for producing firm products having a fine tissue while minimizing a creation of blowholes which has been a fatal disadvantage in the die casting method.

2. Description of the Prior Art

In order to prevent occurrence of blowholes, the interior of a mold is being subjected to secondary processing.

In this case, a secondary processing pressure naturally has to be transmitted into the product, i.e., portions where blowholes are created prior to solidification of molten metal within the mold. However, time at which molten metal is solidified and time required to solidify molten metal area varied according to materials, temperatures, wall thickness of products, etc.

It is desirable that starting time of the secondary processing, pressing time and pressing pressure may be adjusted.

However, in conventional methods, these points have not been taken into consideration, and in addition, a secondary pressing cylinder by electric signals wherein an injection cylinder is detected by a pressure switch, said signal being input into a timer, and as a result, a delay in pressing occurs failing to obtain an effective secondary pressing effect. In order to compensate for this, pressure more than as needed had to be often used for pressing.

Moreover, according to the signals obtained by said detection means, operating timing is unstable to make it difficult to stably recur a desired operation starting time, thus rendering the effect of the secondary pressing unsatisfactory.

Furthermore, a plurality of die casting machines having different performance are used in actual production site. When mold of the same design are applied to these machines which are different in performance from each other, uniform products may not be obtained.

SUMMARY OF THE INVENTION

In accordance with the present invention, the operation starting time of a secondary pressing cylinder may be changed and adjusted with good recurrence and the pressure applying state may also be varied. An object of the present invention is to provide a die casting apparatus in which the same molds are applied to die casting apparatuses different in performance and perform a secondary pressing under the optimum conditions according to material, shape, wall thickness, temperature, etc. thus enabling production of uniform products.

The appartus according to the present invention comprises a secondary pressing cylinder provided with a pressing plunger inserted into a mold, said secondary pressing cylinder being fixedly mounted on one mold, and a sequence valve actuated by detection of a rise in pressure within an injection cylinder, a flow control valve and a reducing valve, said valves being interposed between a switching valve actuated when the injection cylinder is actuated and the secondary pressing cylinder, whereby operating timing of the secondary pressing cylinder is changed by the sequence valve, the moving speed of the pressing plunger is adjusted by the flow control valve, and the pressing force of the pressing plunger is varied by the reducing valve.

DESCRIPTION OF THE PREFERRED EMBODIMENTS

Figure 1A:
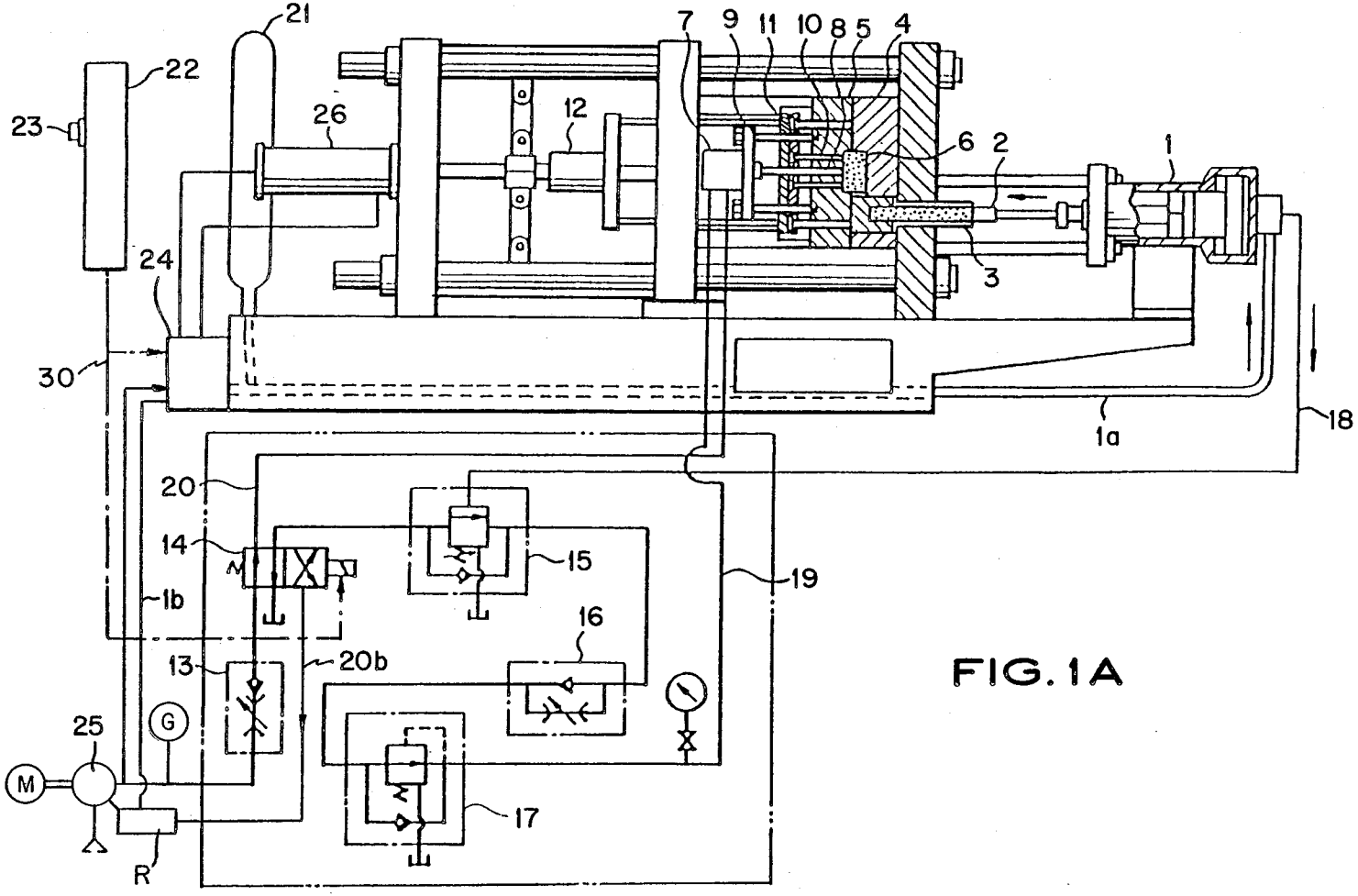
FIG. 1A is a schematic structural view of apparatus according to the present invention.

In the drawings, reference numeral 1 designates an injection cylinder, 2 a plunger tip, 3 a plunger sleeve, 4 a fixed mold, and 5 a movable mold. Reference numeral 6 designates a cavity, and 7 a secondary pressing cylinder fixedly mounted on the movable mold by means of stay bolts 9.

Reference numeral 8 designates a pressing plunger which is provided at a position in which blowholes are liable to create, for example, a thick wall portion or after-machining portion.

The illustrated apparatus relates to a rocker arm in which a product has a center hole, and the pressing plunger 8 is located in the center hole.

Reference numeral 10 designates an extrusion pin, and 11 an extrusion plate which is extruded by an extrusion cylinder 12.

Reference numeral 13 designates a check valve, 14 a switching valve and 15 a sequence valve which is operated by a pressure on the supply side of the injection cylinder 1 applied through a pilot pressure line 18.

Reference numeral 16 designates a flow control valve, 17 a reducing valve, 19 a pressure line connected to a pressure port of the secondary pressing cylinder, and 20 a supply and return line. Fluid pressure is supplied by a pump 25 driven by a motor M and provided with a pressure gauge G.

Figure 1B:
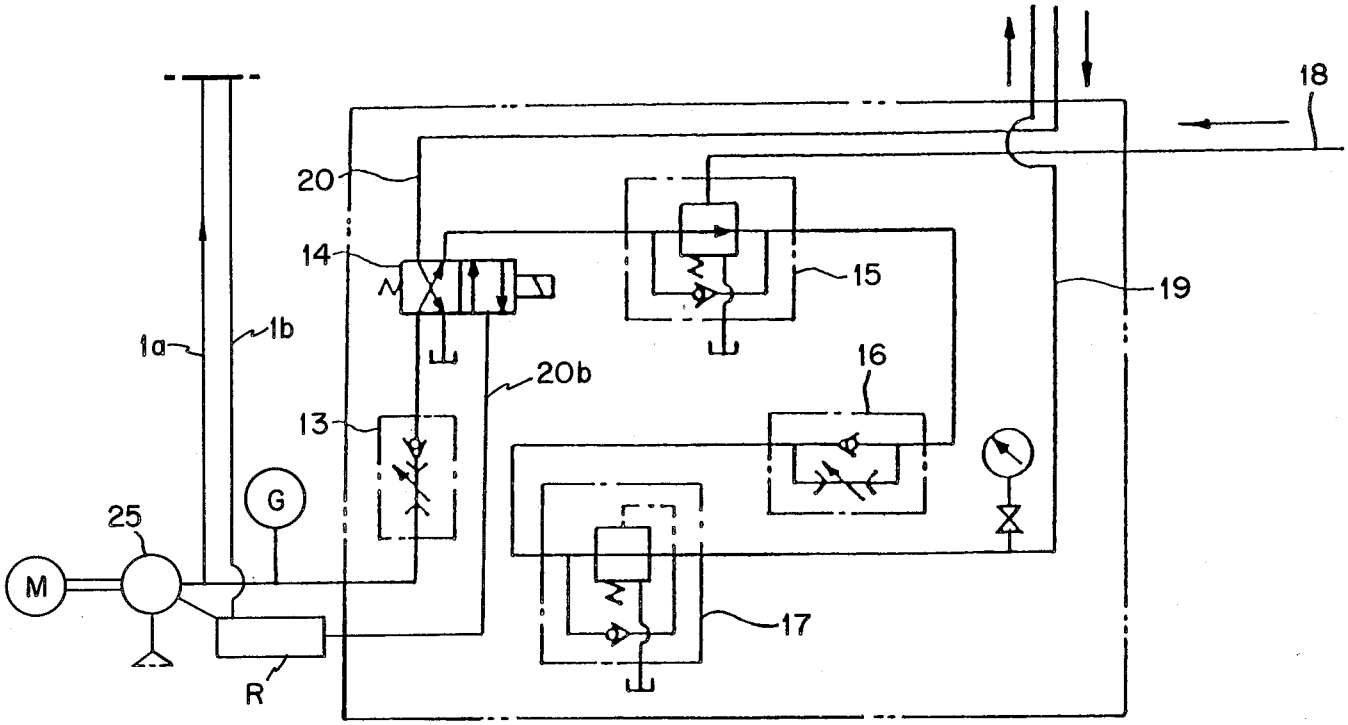
FIG. 1B is a partial schematic structural view of the apparatus in a different condition.

Referring to FIG. 1-A, when the start switch 23 provided on the control board 22 is turned ON, the injection switching valve 24 and the secondary-pressing line switching valve 14 are changed over electrically through line 20. Consequently, the working fluid from a reservoir R is supplied by the pump 25 through the line 1*a* to the injection cylinder 1 and, at the same time, the P-port of the sequence valve 15 provided in the secondary line is placed on standby. The piston of the injection cylinder advances the plunger tip 2.

Figure 2:
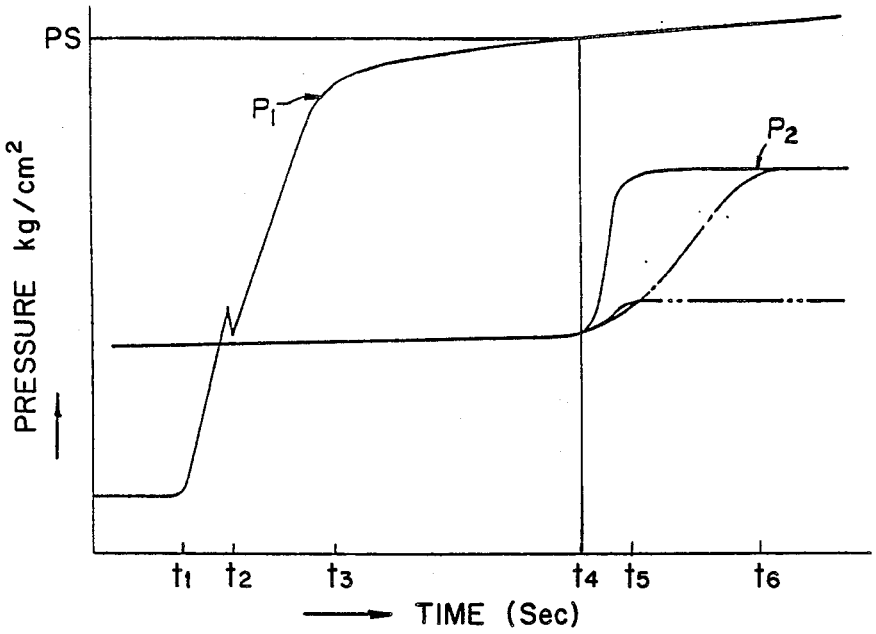
FIG. 2 is a graph showing the relationship between an injection cylinder pressure and a secondary pressing cylinder pressure.

FIG. 2 is a graph showing the variation of the pressure in the injection cylinder for producing the secondary pressure with time. As shown in FIG. 2, the speed of the plunger 2 is increased at time $t_1$, and the cavity 6 is filled up with the molten metal at time $t_2$ to complete injection. The internal pressure of the injection cylinder is caused to increase further as shown in FIG. 2 by the successive supply of the working fluid to the injection cylinder and the open pressure of the accumulator 21. The increasing rate of the internal pressure decreases near time $t_3$, and then the internal pressure increases gradually up to a fixed value in proportion to the rate of supply of the working fluid to the accumulator 21.

The internal pressure of the injection cylinder is applied as pilot pressure to the sequence valve 15. Secondary pressing start time $t_4$, namely, pilot pressure application start time, can be changed by operating the pressure regulating handle. The timing of starting secondary pressing is essential to effective secondary pressing. Excessively advanced timing of secondary pressing in relation to the condition of the injected metal within the cavity causes the molten metal to flow in the reverse direction from the gate to the runner (not shown) which reduces the effect of secondary pressing. On the contrary, excessively delayed timing of secondary pressing causes a dendrite structure to form in the molten metal injected into the cavity, which makes the secondary-pressing plunger 8 unable to enter the cavity by a sufficiently large depth. the timing of secondary pressing is decided selectively for the utmost effect of secondary pressing. The effect of secondary pressing can be evaluated through the examination of the casting by X-ray photography and the measurement of the breaking load of the casting. It is also possible to evaluate the effect of secondary pressing by measuring the weight of specific weight of castings of a particular material cast under fixed casting conditions. Measurement of the weight of the casting is the simplest method of evaluating the effect of secondary pressing.

Figure 3:
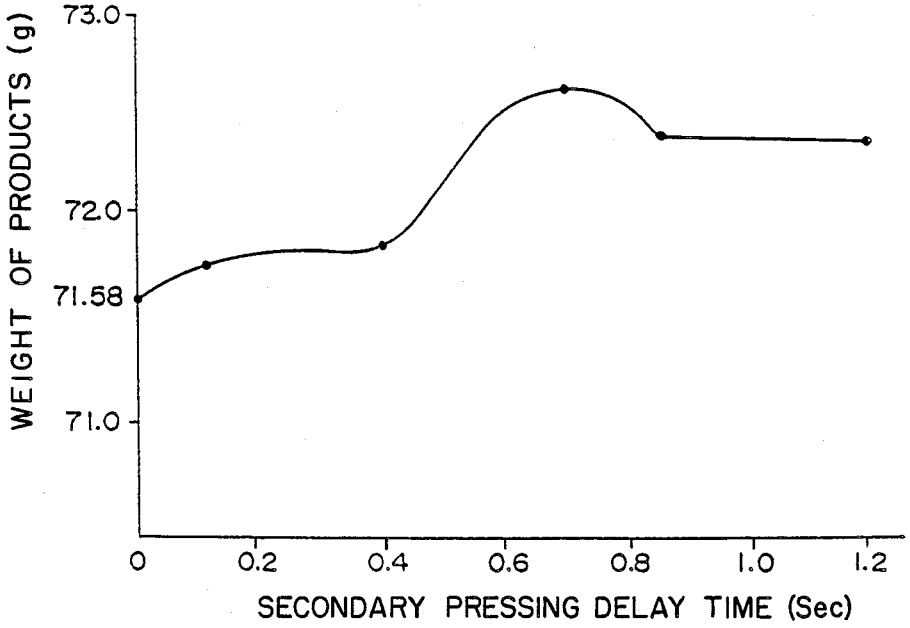
FIG. 3 is a relative graph of the secondary pressing timing and the weight of product.

FIG. 3 is a graph showing the dependence of the weight of the casting on the time period between time $t_2$ when the cavity is filled up with the molten metal and time $t_4$ when secondary pressing is started in casting an aluminum alloy rocking arm for the exhaust valve of an automotive engine of 2 liter displacement. As is obvious from FIG. 3, the weight of the casting increases to the utmost when the time period is 0.7 sec. In practical operation, an optimum timing of starting secondary pressing can be decided by operating the regulating handle of the sequence valve several times for trial-and-error adjustment in the preparatory operation. The cylinder pressure Ps, namely, the pilot pressure of the sequence valve, at time corresponding to the timing of secondary pressing is decided uniquely according to the secondary pressing start timing.

Upon the increase of the cylinder pressure exceeding the pressure Ps, the sequence valve is changed over to make a secondary-pressing circuit 19 as shown in FIG. 1-B to supply the working fluid to the secondary-pressing cylinder 7. In this state, the lines 20 and **20*b* serve as return lines. The internal pressure $P_2$ of the secondary-pressing cylinder reaches a predetermined pressure at time $t_5$ and is held at the same pressure for several seconds. After the passage of a time for which the timer provided in the control board is set, the switching valve 14 is changed over to retract the secondary-pressing plunger 8, the die fastening cylinder 26 is actuated to open the die, and then the casting is ejected from the die by the knockout pin 10. After the casting has been ejected from the die, the injection changeover valve 24 is switched to return fluid through line 1*b* to the reservoir R and thereby retract the plunger tip 2, and then the piston of the knockout cylinder 12** is retracted for the next casting cycle.

In some cases, the stroke of the pressing piston and the diameter of the pressing pin are limited according to the shape of a casting which is subjected to secondary pressing in casting the same. That is, when the volume for secondary pressing is small as compared with the volume of the cavity, there is a possibility of the piston of the pressing cylinder advancing to the limit of stroke when the secondary-pressing plunger is advanced. On the other hand, since the solidification of the molten metal injected into the cavity starts from portions thereof adjacent to the walls defining the cavity toward the portion thereof in the central portion of the cavity, it is possible that secondary pressing is terminated before the portion of the molten metal in the central portion of the cavity, where blowholes are liable to occur, solidifies. In such a case, it is necessary to advance the secondary-pressing plunger at a low speed by using the flow control valve 16 according to the solidification and contraction of the interior of the casting so that the interior of the casting is pressed effectively.

According to the present invention, the flow control valve 16 is regulated to control the advancing speed of the secondary-pressing plunger 8 in a mode as indicated by alternate long and short dash line in FIG. 2 so that time when the pressure for secondary pressing reaches the maximum is delayed, for example, to time $t_6$.

Furthermore, the preferable pressure for secondary pressing in casting a die-cast aluminum alloy rocking arm in the range of 1500 to 2500 kgf/cm$^2$ can readily be reduced as indicated by alternate long and two short dashes line in FIG. 2 by means of the pressure reducing valve 17.

Still further, the pressure regulating function of the pressure reducing valve 17 maintains the line pressure for secondary pressing unaffected by the change of the line pressure applied to the injection cylinder or the change of the hydraulic pump for another, namely, the change of the die casting machine for another, so that the pressure for secondary pressing is maintained constantly at an optimum level.

Figure 4:
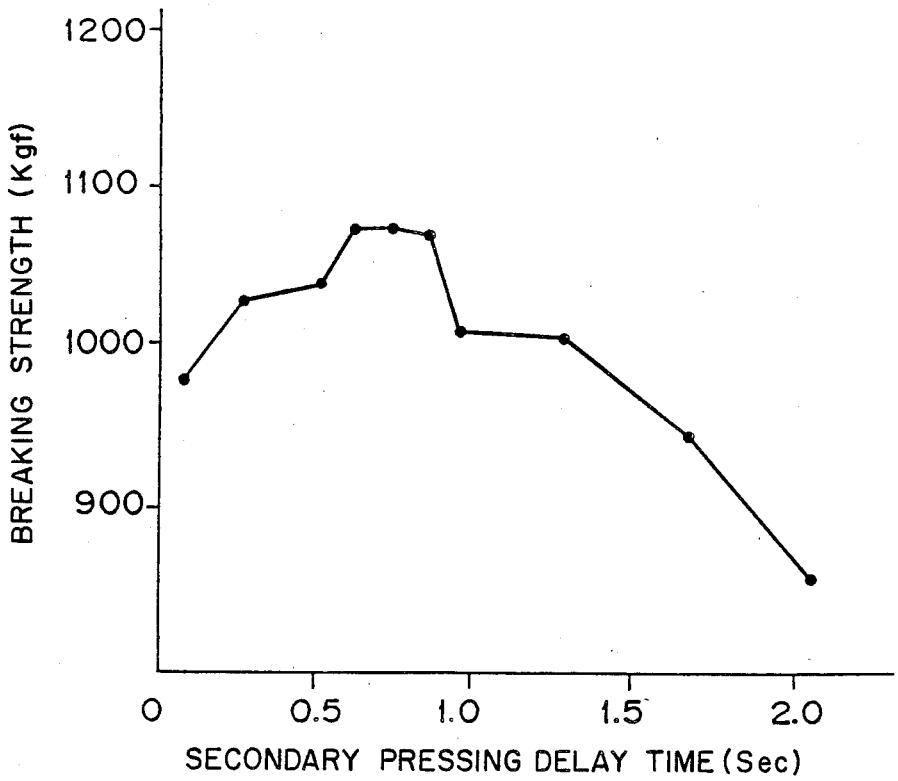
FIG. 4 is a graph showing the relationship between the secondary pressing timing and breaking load.

FIG. 4 is a graph showing the relationship between the secondary pressing delay time and breaking strength of product, in which case also, it is found that the time of about 0.7 second indicates the highest value.

Incidentally, in case of non-pressing, the breaking load is 840 kgf.

As will be apparent from the foregoing, a main factor for effectively imparting the secondary pressing effect to the die cast product resides in the secondary pressing delay time rather than the pressure thereof. When this time lag is small, metal within the cavity flows backward toward the runner to fail to obtain metal pressure. Conversely, when the time lag is too large, metal becomes solidified so that the pressing plunger does not move forward, and the secondary pressing effect cannot be expected.

According to the present invention, the delay time of the secondary pressing which is the most important factor of the secondary pressing effect may be adjusted simply and accurately by adjusting the sequence valve 15 independently of the secondary pressing pressure which is controlled by the pressure reducing valve 17, whereby the blowholes are minimized and in addition, high pressure condensation by secondary pressing may be positively provided to make texture fine and increase the mechanical strength.

As described above, in the present invention, adjustment of the sequence valve for determining the secondary pressing starting timing and adjustment of the reducing valve for setting secondary pressing pressure as needed and the flow control valve for controlling the moving speed of the pressing plunger may be set to the best conditions respectively obtained experimentally thereby effectively imparting the secondary pressing effect to the products with good recurrence.

What is claimed is:

1. In die casting apparatus comprising a mold having a cavity and an injection plunger actuated by an injection cylinder for forcing molten material into said cavity, the improvement comprising means for applying secondary pressing to material in said cavity before it solidifies, said secondary pressing means comprising a pressing plunger actuated by a secondary pressing cylinder mounted on said mold to apply pressure to molten material in said cavity, means for supplying pressure fluid to said secondary pressing cylinder, said pressure fluid supplying means comprising a pump and switching valve means, sequence valve means, flow control valve means and reducing valve means connected in series between said pump and said secondary pressing cylinder, and a pilot pressure line connecting said sequence valve means with said injection cylinder, said switching valve means being operative to supply pressure fluid to an input port of said sequence valve means when pressure fluid is supplied to said injection cylinder, said sequence valve means being actuated by detection, through said pilot pressure line, of a predetermined rise in pressure in said injection cylinder, to supply pressure fluid from said pump to said secondary pressing cylinder, said flow control valve means being operative to control the rate at which pressure fluid is supplied from said sequence valve means to said secondary pressing cylinder, and said reducing valve means being operative to control the pressure of pressure fluid supplied to said secondary pressing cylinder.

* * * * *